US007317287B2

(12) United States Patent
Blumel

(10) Patent No.: US 7,317,287 B2
(45) Date of Patent: Jan. 8, 2008

(54) CIRCUIT FOR AN LED ARRAY

(75) Inventor: Simon Blumel, Schierling (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 0 days.

(21) Appl. No.: 10/496,939

(22) PCT Filed: Nov. 26, 2002

(86) PCT No.: PCT/DE02/04329

§ 371 (c)(1),
(2), (4) Date: Nov. 29, 2004

(87) PCT Pub. No.: WO03/047314

PCT Pub. Date: Jun. 5, 2003

(65) Prior Publication Data

US 2005/0077838 A1 Apr. 14, 2005

(30) Foreign Application Priority Data

Nov. 26, 2001 (DE) ..... 101 57 645
Sep. 12, 2002 (DE) ..... 102 42 365

(51) Int. Cl.
*G05F 1/00* (2006.01)

(52) U.S. Cl. ..... 315/291; 315/185 R; 315/224; 315/302; 362/800

(58) Field of Classification Search ..... 315/185, 315/194, 216, 297, 291, 294, 158, 159, 161, 315/167, 169.3, 185 R, 185 S, 209 R, 224–226, 315/293, 302–303, 307–308, 312; 235/455; 362/800

See application file for complete search history.

(56) References Cited

U.S. PATENT DOCUMENTS

| | | | | |
|---|---|---|---|---|
| 5,144,117 | A * | 9/1992 | Hasegawa et al. | 235/455 |
| 5,149,190 | A * | 9/1992 | MacKenzie | 362/234 |
| 5,278,432 | A | 1/1994 | Ignatius et al. | 257/88 |
| 5,598,068 | A | 1/1997 | Shirai | 315/185 R |
| 5,939,839 | A | 8/1999 | Robel et al. | 315/289.1 |

(Continued)

FOREIGN PATENT DOCUMENTS

| | | | |
|---|---|---|---|
| DE | 30 30 058 | A | 3/1982 |
| DE | 196 18 010 | C | 7/1997 |
| DE | 197 49 333 | A1 | 3/1999 |
| DE | 109 04 891 | A1 | 9/1999 |
| DE | 198 04 891 | A1 | 9/1999 |
| DE | 100 17 878 | A1 | 10/2001 |

*Primary Examiner*—Douglas W. Owens
*Assistant Examiner*—Tung X Le
(74) *Attorney, Agent, or Firm*—Cohen Pontani Lieberman & Pavane LLP

(57) ABSTRACT

A circuit arrangement for an LED array having two or more parallel-connected LED chains (LK1, LK2, LK3), in each of which at least one LED (2) is arranged and, when there are two or more LEDs (2), the latter are connected in series. In each case, the anode sides of the LED chains (LK1, LK2, LK3) can be coupled to the positive pole of a supply voltage ($U_v$) and the cathode sides can be coupled to the negative pole of the supply voltage ($U_v$). A regulating arrangement (RA1, RA2, RA3) for regulating an intended current distribution between the individual LED chains (LK1, LK2, LK3) is case connected in series with the respective LED chain (LK1, LK2, LK3).

22 Claims, 6 Drawing Sheets

U.S. PATENT DOCUMENTS 6,150,771 A * 11/2000 Perry ..... 315/291
6,161,910 A 12/2000 Reisenauer et al. ..... 315/309
6,351,079 B1 * 2/2002 Willis ..... 315/200 A
6,356,365 B1 * 3/2002 Oida et al. ..... 358/475
6,515,434 B1 * 2/2003 Biebl ..... 315/291
6,621,235 B2 * 9/2003 Chang ..... 315/216
6,628,252 B2 * 9/2003 Hoshino et al. ..... 345/82
7,038,398 B1 * 5/2006 Lys et al. ..... 315/291
2002/0067623 A1 * 6/2002 Balakrishnan et al. ..... 363/16
2003/0015968 A1 * 1/2003 Allen ..... 315/185 R
2003/0209997 A1 * 11/2003 St-Germain et al. ..... 315/291

* cited by examiner

CIRCUIT FOR AN LED ARRAY

RELATED APPLICATIONS

This is a U.S. national stage of application No. PCT/DE02/04329, filed on 26 Nov. 2002.

This patent application claims the priority of German patent application nos. 101 57 645.5 and 102 42 365.2 filed 26 Nov. 2001 and 12 Sep. 2002, respectively, the disclosure content of which is hereby incorporated by reference.

FIELD OF THE INVENTION

The present invention relates to a circuit arrangement for an LED array, in particular for a light signal device, having two or more parallel-connected LED chains, in each of which at least one LED (light emitting diode) is arranged, and, when there are two or more LEDs, the latter are connected in series. The anode sides of the LED chains can in each case be coupled to the positive pole of a supply voltage and the cathode sides can in each case be coupled to the negative pole of the supply voltage.

BACKGROUND OF THE INVENTION

In the case of such LED arrays, on account of the steep U/I characteristic curve of LEDs, even small changes in the forward voltage can bring about a great change in current and thus lead to a considerable deviation of the current intensity in the individual LED chains of the LED array from a predetermined desired current intensity.

A variation of the forward voltage of LEDs may, on the one hand, be dictated by production. A fine grouping of the LEDs with regard to the forward voltage (i.e., for each group the range for the forward voltage is comparatively small, so that the number of groups is guite high) is conceivable in order to solve the problem outlined above. This is associated with comparatively high costs since corresponding logistics and stockkeeping are necessary.

On the other hand, the forward voltage of an LED is temperature-dependent, and it is possible for various temperature dependencies to occur, in turn, between individual LEDs. Therefore, a change in temperature may lead to a change in the forward voltages. In order to counteract an associated change in the current intensity in the LED chains, an electrical resistor is connected in series with each LED chain, for example, in the case of conventional circuits. Said resistor leads overall to a flatter U/I characteristic curve of the relevant LED chain, thereby achieving a certain limitation of the current in the LED chain. However, rising accuracy requirements when complying with a predetermined current distribution between the individual LED chains are accompanied by an increase in the magnitude of said resistor and thus the voltage dropped across the latter, thereby impairing the efficiency of the overall system.

Furthermore, an alteration of the forward voltage of an LED chain may also be caused by the failure of individual LEDs, for example due to a short circuit of an LED. In the case of a current setting by means of series-connected resistors, this leads to a major redistribution of currents in the LED chains.

SUMMARY OF THE INVENTION

One object of the invention is to provide a circuit arrangement for an LED array of the type mentioned, in which a predetermined distribution of the currents between the individual LED chains is maintained to the greatest possible extent even in the event of different forward voltages or an alteration of the forward voltages in the individual LED chains. In particular, the predetermined current distribution is intended to remain as far as possible unchanged even in the event of a short circuit of an LED or the interruption of an LED chain.

This and other objects are attained in accordance with one aspect of the invention directed to a circuit arrangement for an LED array having two or more parallel-connected LED chains, in each of which at least one LED is arranged and, when there are two or more LEDs, the latter are connected in series, in which in each case the anode sides of the LED chains can be coupled to the positive pole of a supply voltage and the cathode sides can be coupled to the negative pole of the supply voltage, it is provided that a regulating arrangement for regulating a predetermined current distribution between the individual LED chains is in each case connected in series with each LED chain.

In this case, the regulating arrangements preferably in each case comprise a current amplifying circuit for impressing the current into the respective LED chain. In this case, the current amplifying circuits may in each case have a regulating input for regulating the current in the LED chain, the regulating inputs of the current amplifying circuits being connected to one another.

In the case of the invention, LEDs are to be understood as light emitting diodes of any type, in particular in the form of LED components.

In a preferred refinement of the invention, a combination of a transistor with an emitter resistor is in each case provided as the regulating arrangement, the collector-emitter path and the emitter resistor respectively being connected in series with the respective LED chain. It is particularly preferred in this case for the base terminals of the transistors, which represent the abovementioned regulating inputs, to be connected to one another and to be at the same potential during operation.

The emitter resistor serves, in particular, for setting the current distribution between the LED chains. In this case, the value of the emitter resistors is in each case inversely proportional to the corresponding emitter current, which, to an approximation, corresponds to the collector current or the current in the associated LED chain (excluding interrupted LED chains, as will be explained in more detail below).

In a preferred development of the present invention, a drive circuit applies a predetermined current to the base terminals of the transistors. In a first embodiment of the invention, in this case, respective separate drive circuits are provided for the individual LED chains. In a second embodiment of the invention, a common drive circuit is provided for a plurality of the LED chains, preferably for all of the LED chains.

Preferably, in the first embodiment of the invention, the drive circuit that applies a predetermined current to the base terminals of the transistors is in each case formed as a series circuit comprising a diode and a resistor, which series circuit in each case connects collector and base terminals of the transistors. The diodes ensure, on the one hand, that the operating conditions for the transistors are fulfilled and, on the other hand, prevent a redistribution of the currents in the LED chains via the common connection of the base terminals.

An alteration in the forward voltage of an LED chain which may be caused for example by a change in temperature or by the short circuit of an LED, is intercepted by means of the drive circuit through a corresponding alteration of the associated collector-base voltage, so that the collector current and thus the current in the relevant LED chain do not change, or change only to a small extent.

If, by way of example, an LED fails in an LED chain due to a short circuit, then the forward voltage of the LED chain decreases. This is compensated for by means of the associated regulating arrangement in that the collector-base voltage increases at the associated transistor. Since only the respective base current of the transistors flows via the resistors of the drive circuit, said base current for instance typically being a factor 100 to 250 less than the collector current, the resistors may in each case be dimensioned in such a way that even in the event of a small change in the current through the resistor, a sufficiently high voltage for compensating for the different forward voltages in the individual LED chains is dropped across the resistor.

The opposite fault situation to a short circuit of an LED is constituted by a failure of an LED which interrupts the LED chain. This may be caused for example by an overloading of the LED, so that the LED "burns out".

Current then no longer flows in the associated LED chain, and the voltage between collector and base of the associated transistor collapses. The base of the transistor of the defective chain is still at the same potential on account of the common electrical connection of the transistor base terminals. The transistor of the defective LED chain is thus operated as a diode, the compensating currents necessary for this flowing via the intact LED chains and the connection of the transistor base terminals. The current distribution predetermined by the dimensioning of the emitter resistors is preserved for the remaining intact LED chains, the currents in the intact LED chains being approximately equal to the respective emitter currents and once again in each case inversely proportional to the corresponding emitter resistors.

All further operating or fault states with regard to the forward voltages of the LED chains between the extreme cases of a short circuit and an interruption of an LED and LED chain, respectively, are also compensated for in a corresponding manner, so that the current distribution in the LED chains (apart from an interrupted LED chain) is largely maintained.

In particular, in the case of the circuit arrangement according to the invention, the current distribution provided is kept constant even in the event of extreme changes in the forward voltages. In this case, the collector currents or the currents in the LED chains typically fluctuate only by a few mA. It is advantageous that neither an interruption of an LED chain nor a short circuit in an LED chain leads to the collapse of the current distribution. A costly grouping of the LED components according to forward voltages is not necessary.

In the first embodiment of the invention, the values of the resistors in the drive circuit preferably lie in the range of between 100 ohms and 1000 ohms. Thus, sufficiently high compensating voltages for compensating for different forward voltages of the LED chains can be generated even by relatively small currents.

In a preferred second embodiment of the invention, the drive circuit which applies a predetermined current to the base terminals of the transistors in the regulating arrangements is formed as a zener diode operated in the reverse direction, which is preferably connected in series with a resistor and/or a fuse. On the transistor side, the zener diode is connected to the base terminals.

The zener diode and the resistor represent a common current supply for the respective transistor base terminals. The difference between the forward voltage of the respective LED chain and the voltage dropped across the drive circuit is present at the respective transistor of a regulating arrangement as collector-base voltage. An alteration of the forward voltage of an LED chain is compensated for by a corresponding alteration of the associated collector-base voltage, so that the collector current and thus the corresponding current in the LED chain do not change, or change only very slightly.

In this second embodiment, the base current for the transistors is passed via a single common current path. In this case, the supply of the base terminals of the transistors may be realized by a current path beside the array into which the drive circuit, for example the zener diode, is incorporated. This reduces the circuit complexity for an LED array in comparison with the first embodiment. The zener diode should have a zener voltage which is approximately 1 V greater than the largest forward voltage of the LED chains. This ensures a stable operating state for the transistors.

In the case of the first embodiment, by contrast, the voltage required for the regulating arrangements is lower, so that this embodiment, principally in the case of longer LED chains, represents an overall system which is more advantageous from an energy standpoint.

If, in the second embodiment of the invention, an LED fails in an LED chain due to a short circuit, then the forward voltage of the LED chain decreases. This is compensated for by means of the associated regulating arrangement in that the collector-base voltage increases at the associated transistor. The respective collector currents or currents in the LED chains thus remain approximately constant.

If, by contrast, in the second embodiment of the invention, an LED chain is interrupted, for example because an LED burns out, then current no longer flows through the defective LED chain and the voltage between collector and base of the associated transistor collapses. The base of the transistor of the defective chain is still at the same potential on account of the common electrical connection of the transistor base terminals, and the transistor of the defective chain is operated as a diode. The compensating currents required for this flow via the zener diode and the common connection of the transistor bases. The current distribution predetermined by the dimensioning of the emitter resistors is preserved for the remaining intact LED chains, the currents in the LED chains being approximately equal to the emitter current and once again inversely proportional to the emitter resistors.

Thus, the abovementioned advantages of the first embodiment are also achieved with the second embodiment of the invention.

In an advantageous development of the invention, the fuse in series with the zener diode is embodied as a fusible resistor. This prevents, in particular, the transistors from being destroyed in the event of overloading of the array.

The value of the resistor in series with the zener diode preferably lies in the range between 100 ohms and 1000 ohms, so that the required compensating voltages can once again be generated with relatively small currents.

Moreover, in both embodiments of the invention, it is advantageous to provide a fuse connected in series with the LED chains, for example a fusible resistor. In this way, individual defective LED chains are switched off in a defined manner in the event of an excessively high current in the LED chain. As described above, in the case of the accompanying interruption of an LED chain as well, the predetermined current distribution is maintained in the remaining LED chains.

Since the currents in the LED chains are inversely proportional to the respective emitter resistors, the LED array can be configured flexibly, it being possible, in particular, to set a predetermined current without a particular effort for each LED chain. As a rule, a uniform current distribution will be desired, which can readily be realized by identical emitter resistors.

DETAILED DESCRIPTION OF THE DRAWINGS

Identical or identically acting elements are provided with the same reference symbols in the figures.

Figure 1:
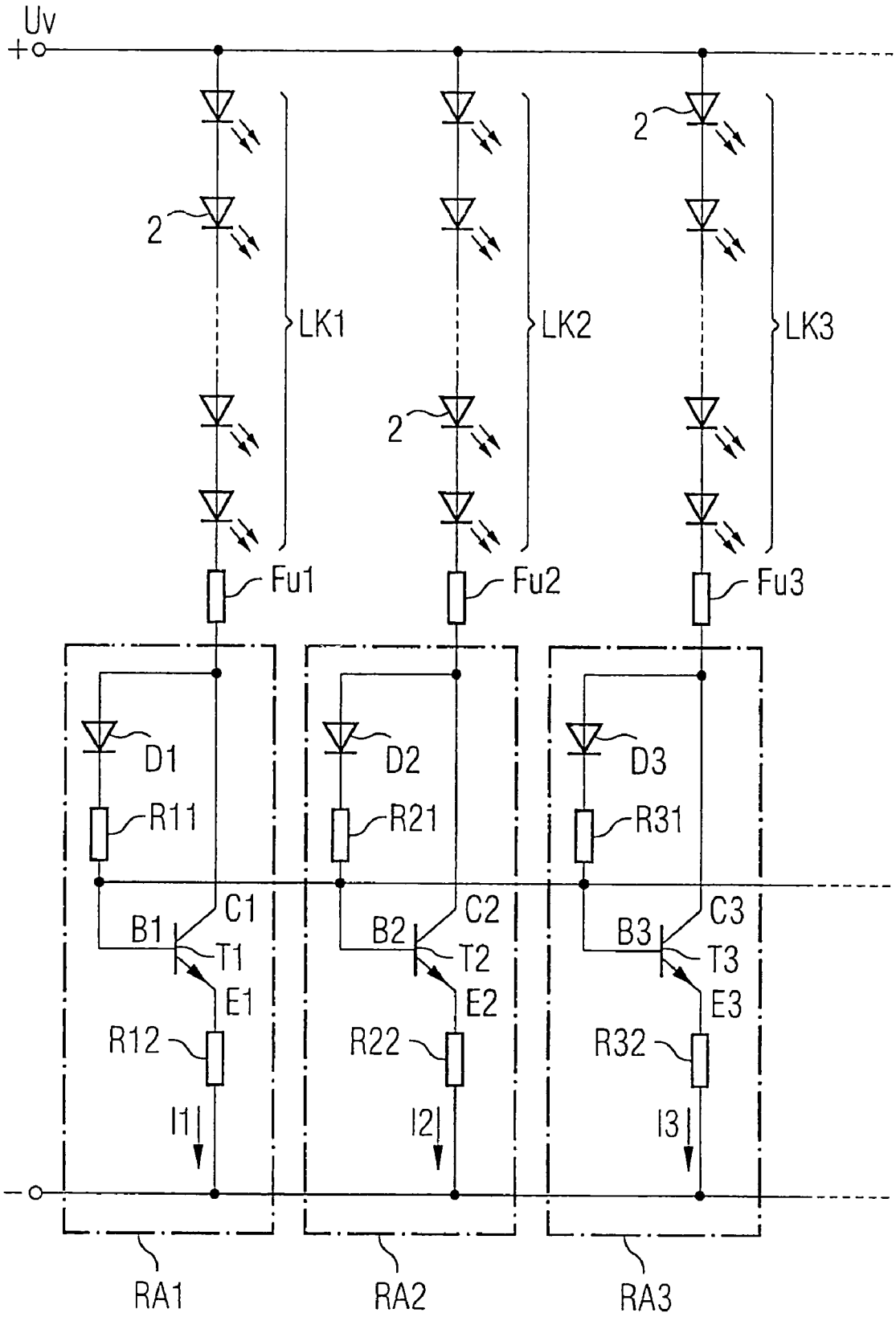
FIG. 1 shows a schematic circuit diagram of a first exemplary embodiment of the invention in accordance with the first embodiment.

In the circuit diagram shown in FIG. 1, a plurality of LEDs 2 are in each case connected in series to form LED chains. The illustration shows three chains LK1, LK2, LK3 each having four LEDs, it being possible, of course, for a circuit arrangement according to the invention also to comprise a different number of LEDs in the LED chains or a different number of LED chains. This is illustrated by the broken lines in the supply voltage lines (see below), in the connection of the transistor based terminals (see below) and in the LED chains. Furthermore, the number and also the type of LEDs in the individual LED chains may also vary from chain to chain.

A fusible resistor Fu1, Fu2, Fu3 may optionally be connected in series with the LED chains LK1, LK2, LK3. The LED chains LK1, LK2, LK3 are in each case connected to the positive pole of a supply voltage $U_v$ on the anode side and are in each case connected to a regulating arrangement RA1, RA2, RA3 on the cathode side.

The regulating arrangements RAl, RA2, RA3 each comprise an npn transistor T1, T2, T3, the collector terminal C1, 02, 03 of which is respectively connected to the cathode side of the associated LED chain LK1, LK2, LK3 or to the possibly interposed fusible resistor Fu1 Fu2, Fu3. The emitter terminal E1, E2, E3 is respectively connected via an emitter resistor R12, R22, R32 to the negative pole of a supply voltage $U_v$.

In the arrangement illustrated, the transistors T1, T2, T3 are embodied as commercially available npn transistors. A drive circuit in the form of a series circuit comprising a diode D1, D2, D3 and an electrical resistor R11, R21, R31 is in each case connected between the cathode side or the fusible resistor of each LED chain and the respective base terminal B1, B2, B3 of the associated transistor T1, T2, T3.

The base terminals B1, B2, B3 of the transistors T1, T2, T3 are connected to one another.

During operation, a voltage Ux2=Rx2*Ix is dropped across the resistors Rx2 given energization with the current intensity Ix. Here and below, the running index x designates the number of the LED chain. Thus, in the example shown, x=1 is applicable to the left-hand LED chain, x=2 is applicable to the middle LED chain and x=3 is applicable to the right-hand LED chain LK3. The following description also generally applies to an LED array having N LED chains, in which case x then lies between 1 and n.

In this case, the current Ix, which corresponds to the current in the respective LED chain LKx apart from the respectively very much smaller base current, is regulated in such a way that a voltage of approximately 0.65V occurs at the base-emitter junction of the associated transistor Tx.

Since the base inputs B1, B2, B3 of the transistors T1, T2, T3 are electrically interconnected and are at the same potential, the current is set via the transistors T1, T2, T3 in such a way that the voltage dropped across the emitter resistors lies approximately 0.65V below the common base potential. Since the voltage between base and emitter of 0.65V is (virtually) identical in the case of the transistors T1, T2, T3, for this purpose the same voltages have to be dropped across the respective emitter resistors R12, R22, R32. The currents I1, I2, I3 in the LED chains are thus regulated in such a way that the voltages U12, U22, U32 are identical. Overall, the distribution of the currents between the LED chains is thus defined by the emitter resistors R12, R22, R32, the ratio of the currents being equal to the ratio of the reciprocal resistances of the emitter resistors.

In this consideration, the emitter current, composed of the associated base and collector current, has in each case been equated to the collector current, that is to say the base current, which is significantly smaller in comparison, has been disregarded.

If the intention is to divide an overall current uniformly between all the LED chains LK1, LK2, LK3, then all the emitter resistors R12, R22, R32 must have the same resistance. A different energization of the various chains can be realized without special effort by means of different values for the emitter resistors R12, R22, R32. The energization of the LED chains can thus advantageously be adapted depending on the requirement, without the need for further, if appropriate more complicated, changes to the circuit.

An alteration of the forward voltage of an LED chain LKx, e.g. due to a short circuit of an LED, is intercepted by means of a corresponding alteration of the associated collector-base voltage. The above-explained setting of the emitter current Ix and thus of the current in the LED chain LKx remains virtually unaffected by this, so that the collector current or the current in the LED chain does not change, or changes only slightly.

If, in the extreme case of an interruption of an LED chain LKx, the current in the LED chain or the collector current is reduced to zero, then the voltage Ux2 across the associated emitter resistor Rx1 is maintained by a corresponding change in the base current. This is made possible by means of the common electrical connection of the transistor base terminals. The approximation that the base current can be disregarded with respect to the collector current no longer holds true in this exceptional case.

The supply of current to the base inputs B1, B2, B3 of the transistors T1, T2, T3 is realized in each case by means of a drive circuit in the form of a series circuit comprising a diode D1, D2, D3 and a resistor R11, R21, R31.

In this case, the diodes D1, D2, D3 are accorded a dual function, on the one hand, they ensure the operating condition of the transistors T1, T2, T3, i.e. the required voltage at the respective collector-base junction Cx-Bx; on the other hand, they suppress shunt currents between the individual LED chains LK1, LK2, LK3. This last has the effect that, via the common electrical connection of the transistor bases B1, B2, B3, no current, for example on account of potential differences in the individual LED chains LK1, LK2, LK3 which may be caused for instance owing to different forward voltages or a short-circuited LED, can flow from one LED chain into another LED chain.

The diodes D1, D2, D3 are dimensioned in such a way that a voltage which suffices for a stable operating state of the transistors T1, T2, T3 is dropped across said diodes. By way of example, LEDs could also be used here, which LEDs may additionally serve as an optical indicator for different forward voltages in the individual chains.

The base current of the transistors T1, T2, T3, which is typically a factor of 100 to 250 less than the collector current, flows via the electrical resistors R11, R21, R31. The said resistors R11, R21, R31 are preferably dimensioned in such a way that even a very small alteration of the base current through the resistor Rx1, for example in the region of less than 1 mA, brings about a sufficiently large change in the voltage across the resistor Rx1, thereby compensating for different forward voltages or a change in the forward voltages in the individual LED chains LK1, LK2, LK3. For this purpose, the resistors R11, R21, R31 preferably have values in the range of 100 ohms to 1000 ohms.

In the event of the interruption of an LED chain, the compensating currents for maintaining the voltage across the emitter resistor of the interrupted LED chain also flow via the drive circuits of the remaining chains.

In principle, the resistors R11, R21, R31 need not necessarily have the same value. Identical resistances are advantageous for an optimum reliability and the symmetry of the arrangement.

In the case of the circuit shown, a sufficient stability of the circuit with respect to production-dictated fluctuations in the current gain factors, i.e. the ratio of collector current to base current, of the transistors T1, T2, T3 is ensured in particular by the emitter resistors R12, R22, R32.

In a further variant, which is advantageous particularly in the case of increased safety requirements, a fuse Fux is preferably in each case connected in series with an LED chain LKx, which additionally prevents an excessively large current in an LED chain. In the event of a fault, for example if twice the desired current flows in an LED chain LKx, the fuse blows and thus switches off the LED chain in a defined manner. The LED chain is thus interrupted. As already described, it is advantageous in this case that, in the event of such an interruption, the current distribution is maintained in the still intact LED chains. The fuses Fu1, Fu2, Fu3 may be embodied as a fusible resistor, for example. In this case, it is possible to use commercially available fusible resistors which blow starting from a defined power and thus permanently interrupt the current flow.

A further advantage of the first embodiment of the invention or the exemplary embodiment illustrated in FIG. 1 is that a partial current is branched off for regulating purposes in each LED chain LKx. This increases the reliability and stability of the system. When using emitter resistors R12, R22, R32 with a 1% tolerance, the tolerance of the base currents is 2%, with the result that a comparatively high precision of the current distribution is obtained overall.

As already explained, the circuit arrangement in accordance with FIG. 1 can be extended by any desired number of LED chains in the manner illustrated.

Figure 2:
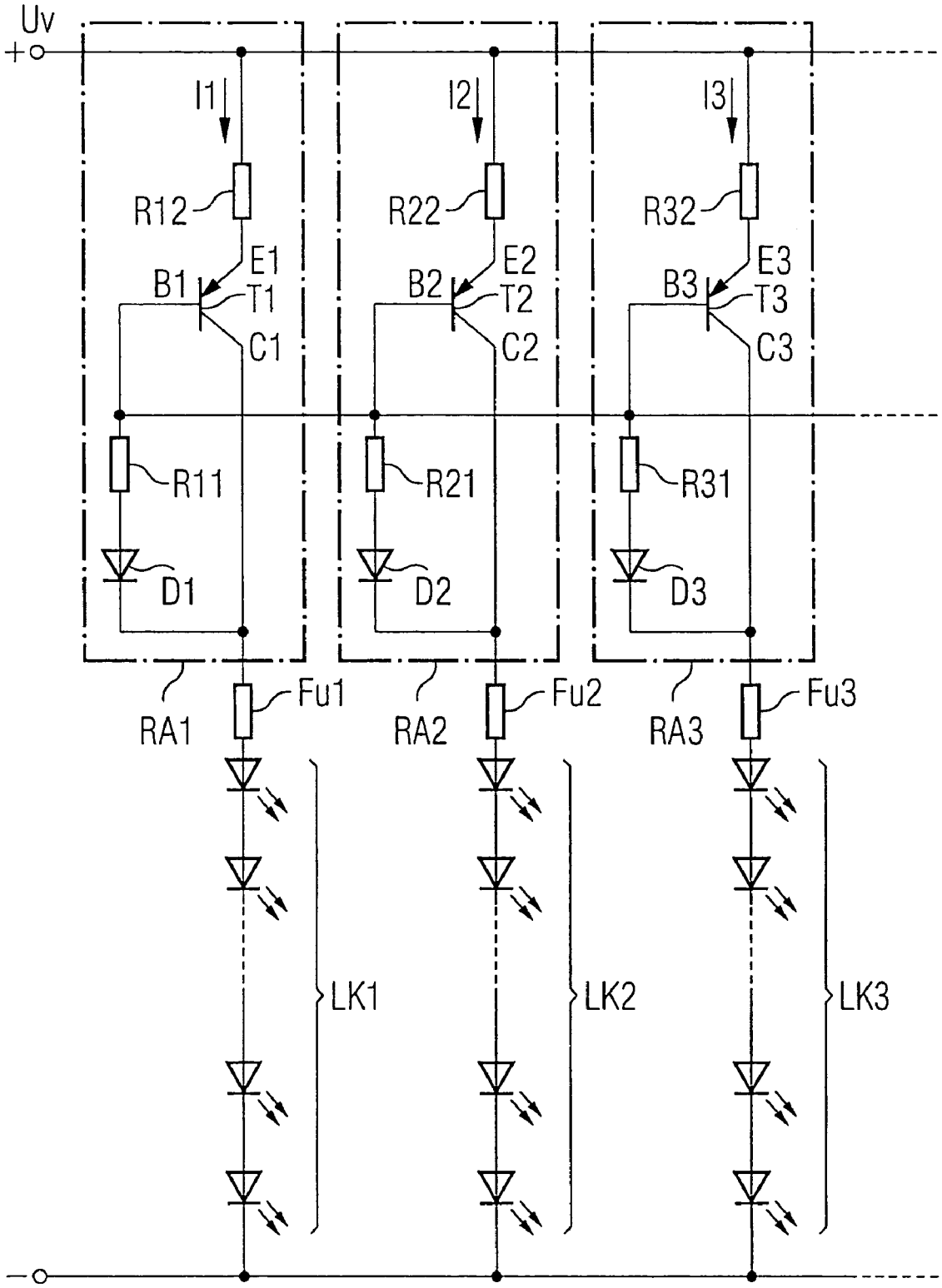
FIG. 2 shows a schematic circuit diagram of a second exemplary embodiment of the invention in accordance with the first embodiment.

The circuit shown in FIG. 1 can also be constructed in an analogous manner using pnp transistors. A corresponding second exemplary embodiment of the invention is illustrated in FIG. 2. In this case, the regulating arrangements RA1, RA2, RA3 with the transistors T1, T2, T3, the emitter resistors R12, R22, R32 and the drive circuits comprising the resistors R11, R21, R31 and the diodes D1, D2, D3 are arranged between the anode sides of the LED chains LK1, LK2, LK3 and the positive pole of the supply voltage $U_v$.

Figure 3A:
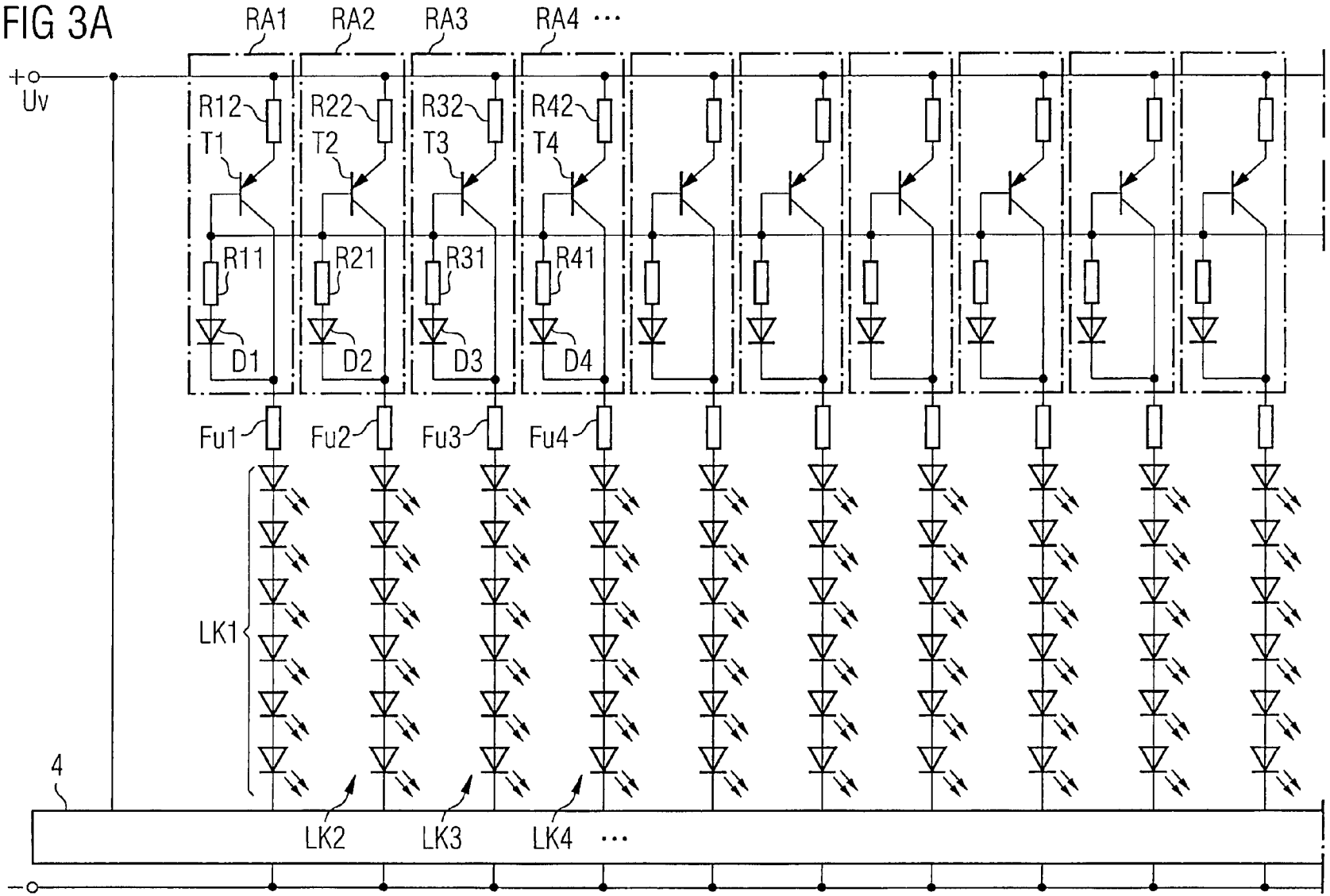
FIG. 3 shows a schematic circuit diagram of a third exemplary embodiment of the invention in accordance with the first embodiment.
Figure 3B:
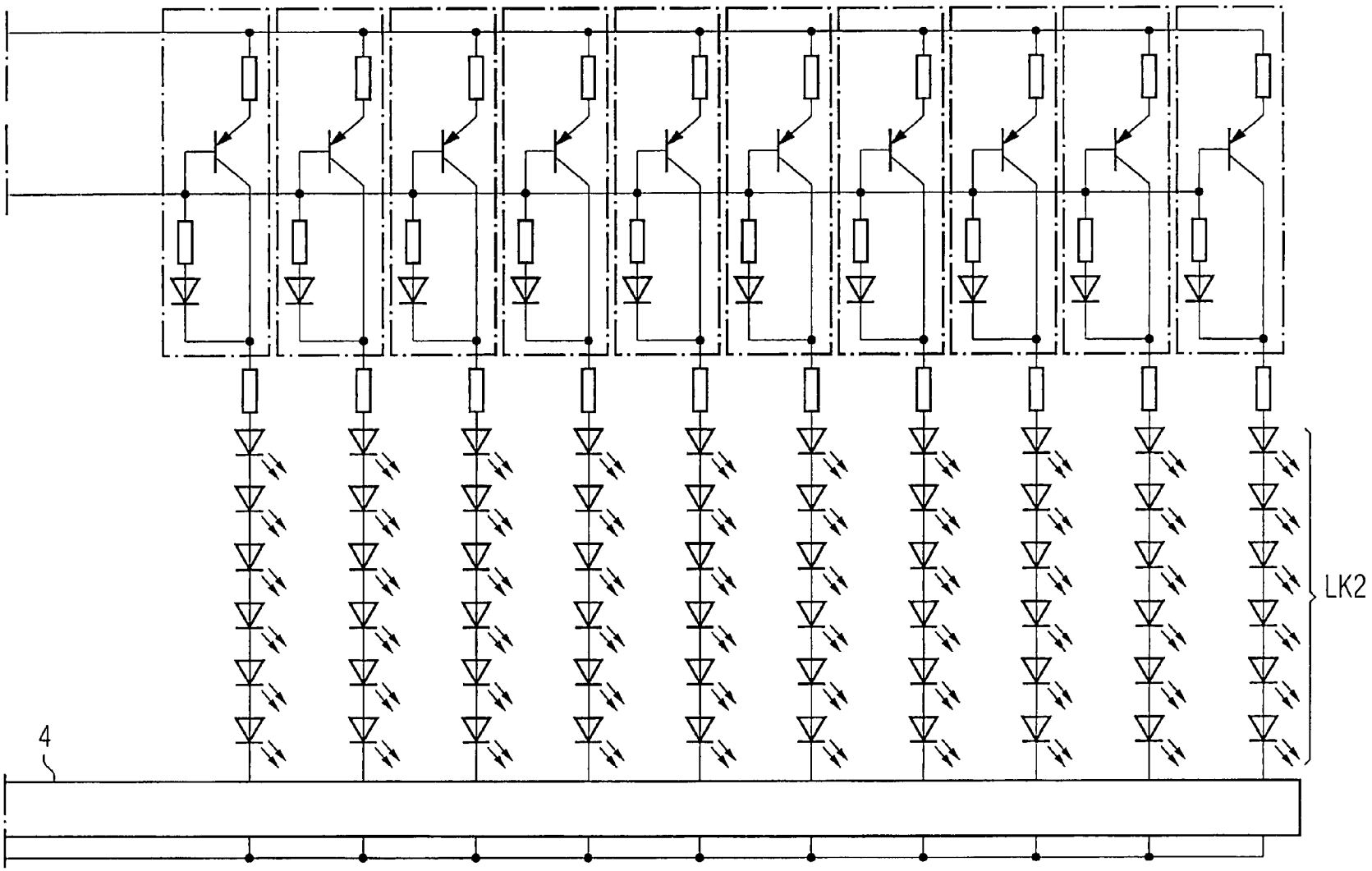

The third exemplary embodiment of the invention as shown in FIG. 3 shows an LED array in a size which is used for example in signaling technology. Corresponding circuits may be used for example for traffic signals such as traffic lights or warning lights or for railroad signals.

The circuit essentially corresponds to FIG. 2. In contrast thereto, a total of 120 LEDs 2 are connected in parallel in 20 LED chains LK1, . . . , LK20 each having 6 LEDs. The currents in the LED chains of the LED array are additionally controlled by a monitoring circuit 4, which is not described in any more detail here.

In arrays of this size, it is particularly important to obtain a highest possible efficiency. The possibility—described in the introduction—according to the prior art of compensating for different forward voltages of the LED chains of the array by means of purely ohmic series resistors would in this case lead to a very high power loss and consequently to complicated cooling measures.

Figure 4:
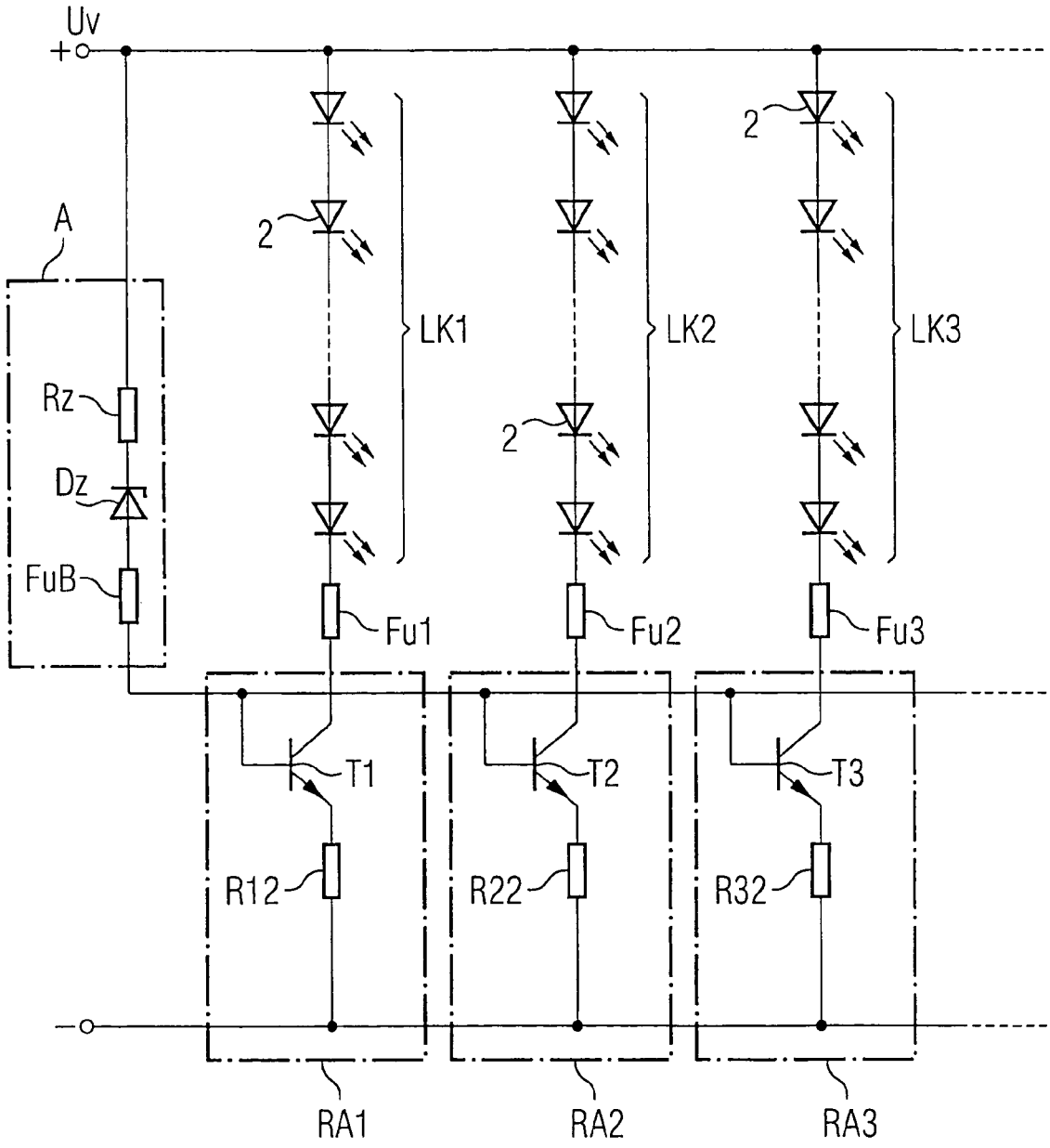
FIG. 4 shows a schematic circuit diagram of a fourth exemplary embodiment of the invention in accordance with the second embodiment.

FIG. 4 shows a fourth exemplary embodiment in accordance with the second embodiment of the invention. As in the case of the exemplary embodiment illustrated in FIG. 1, here as well a plurality of LEDs 2 are in each case connected in series to form LED chains LK1, LK2, LK3 and the LED chains LK1, LK2, LK3 are connected, on the anode side, to the positive pole of a supply voltage and, on the cathode side, via an optional fuse Fu1, Fu2, Fu3, in each case to a regulating arrangement RA1, RA2, RA3.

The regulating arrangements RA1, RA2, RA3 once again in each case comprise a transistor Tx, the collector terminal Cx of which is connected to the corresponding LED chain LKx. The emitter terminal Ex is in each case connected via an emitter resistor Rx2 to the negative pole of the supply voltage.

As in the previous exemplary embodiments, the base terminals B1, B2, B3 of the transistors T1, T2, T3 are connected to one another and are thus at the same potential.

In contrast to the exemplary embodiments shown in FIGS. 1 to 3 in accordance with the first embodiment of the invention, in the case of the exemplary embodiment shown in FIG. 4 according to the second embodiment of the invention, a common drive circuit A is provided, which generates the base current for the transistors T1, T2, T3. A series circuit comprising a reverse-biased zener diode Dz and a resistor Rz serves as the drive circuit.

Said series circuit may optionally comprise a fuse FuB, for example a fusible resistor. Said fuse is dimensioned in such a way that it blows in the case of a predetermined number of interrupted LED chains which, as described, each lead to a rise in the base current. The entire LED array is thus switched off. Such a method of operation may be expedient, for example, if the remaining number of intact LED chains no longer satisfies the safety requirements.

The fuses Fu1, Fu2, Fu3 are likewise optional and serve, as described above, for additionally safeguarding the LED chains against excessively high currents.

The resistor Rz connected in series with the zener diode Dz preferably has a value of between 100 ohms and 1000 ohms.

For a uniform base current division in all the chains, the emitter resistors R12, R22, R32 must have the same value in this case as well. In special applications, however, different emitter resistors may also be necessary, for example when combining LEDs of different colors, which generally differ with regard to their specified operating currents.

The zener diode is dimensioned in such a way that the voltage dropped across it ensures a stable operating state of the transistors. The zener voltage of the zener diode Dz is preferably approximately 1 V greater than the highest forward voltage of the LED chains.

Figure 5:
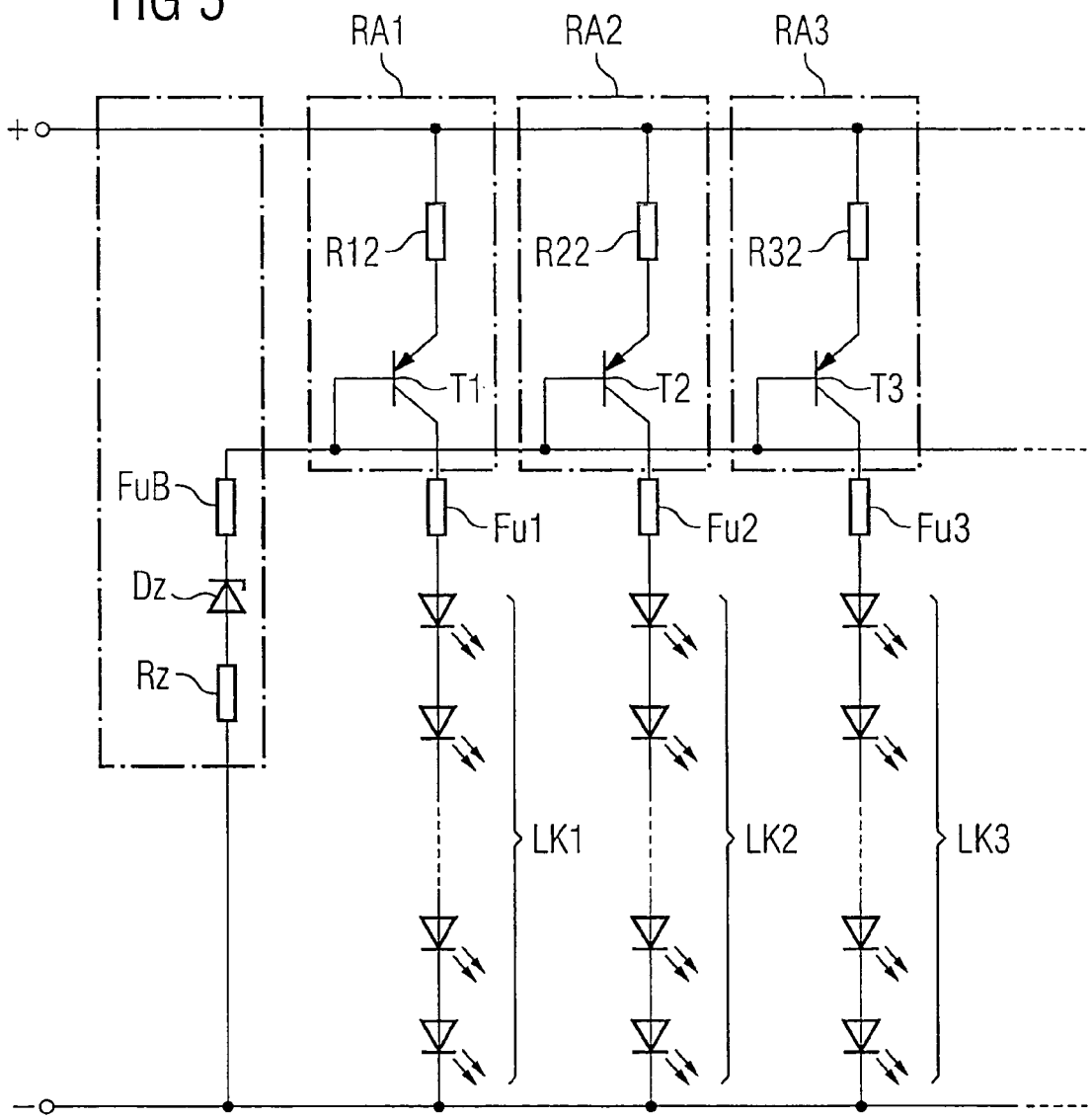
FIG. 5 shows a schematic circuit diagram of a fifth exemplary embodiment of the invention in accordance with the second embodiment.

FIG. 5 shows a fifth exemplary embodiment of the invention in accordance with the second embodiment. In contrast to the exemplary embodiment illustrated in FIG. 4, the regulating arrangements RA1, RA2, RA3 are realized with pnp transistors T1, T2, T3 instead of with npn transistors.

Accordingly, the regulating arrangements are in each case arranged between the positive pole of the supply voltage and the anode sides of the LED chains. As in FIG. 4, the drive circuit is embodied as a series circuit comprising a zener diode Dz and a resistor Rz and, if appropriate, an optional fuse FuB, the zener diode being connected to the negative pole of the supply voltage via the resistor Rz on the anode side.

Depending on the requirement, the first or the second embodiment of the invention may be more advantageous. In this case, the first embodiment is distinguished by a particular stability since generally all the LED chains contribute to the current for the regulation. Furthermore, this first embodiment has the higher overall efficiency in comparison with the second embodiment.

On account of the common drive circuit for the LED chains, the second embodiment requires a lower effort on circuitry and can be switched off particularly easily via the common connection between drive circuit and regulating arrangement, for example by means of the fuse FuB as described.

It goes without saying that the explanation of the invention on the basis of the exemplary embodiments is not to be understood as a restriction thereto.

The invention is not restricted by the description of the invention on the basis of the exemplary embodiments. Rather, the invention encompasses any new feature and also any combination of features, which comprises in particular any combination of features in the patent claims, even if this combination is not explicitly specified in the patent claims.

The invention claimed is:

1. A circuit arrangement for an LED array, comprising:

a plurality of parallel-connected LED chains, in each of which at least one LED is arranged, and when there are two or more LEDs, the latter are connected in series, in which anode sides of the respective LED chains are coupled to a positive pole of a supply voltage and cathode sides of the respective LED chains are coupled to a negative pole of the supply voltage;

a plurality of regulating arrangements for regulating a predetermined current distribution among the LED chains, with said plurality of regulating arrangements being respectively connected in series with said LED chains such that each of said LED chains has a different one of said plurality of regulating arrangements connected in series with said each LED chain;

wherein each of said regulating arrangements includes one of a following transistor arrangement:

a) a bipolar transistor, a collector terminal of which is connected to the cathode side of the associated LED chain, and an emitter terminal of which is connected via an emitter resistor to the negative pole of the supply voltage, or b) a bipolar transistor, a collector terminal of which is connected to the anode side of the associated LED chain, and an emitter terminal of which is connected via an emitter resistor to the positive pole of the supply voltage;

a drive circuit applying a predetermined current to base terminals of the bipolar transistors; and wherein said drive circuit comprises a series circuit formed by a diode and a resistor, said series circuit being arranged between the respective collector terminal and the respective base terminal of the transistor of a regulating arrangement.

2. The circuit arrangement for an LED array as claimed in claim 1, wherein each of said regulating arrangements comprises a current amplifying circuit for impressing a current into the LED chains in accordance with the predetermined current distribution.

3. The circuit arrangement for an LED array as claimed in claim 2, wherein each of said current amplifying circuits has a regulating input for regulating the current in the associated LED chain, the regulating inputs for said current amplifying currents being connected to one another.

4. The circuit arrangement for an LED array as claimed in claim 1, wherein the emitter resistors serve for setting the currents in the respective LED chains.

5. The circuit arrangement for an LED array as claimed in claim 1, wherein the values of the emitter resistors lie between 1 ohm and 100 ohms.

6. The circuit arrangement for an LED array as claimed in claim 5, wherein the values of the emitter resistors are approximately 10 ohms.

7. The circuit arrangement for an LED array as claimed in claim 1, wherein the LED array is a light signal device.

8. The circuit arrangement for an LED array as claimed in claim 1, wherein the base terminals of the bipolar transistors are connected to one another.

9. A circuit arrangement for an LED array, comprising:

a plurality of parallel-connected LED chains, in each of which at least one LED is arranged, and when there are two or more LEDs, the latter are connected in series, in which anode sides of the respective LED chains are coupled to a positive pole of a supply voltage and cathode sides of the respective LED chains are coupled to a negative pole of the supply voltage;

a plurality of regulating arrangements for regulating a predetermined current distribution among the LED chains, with said plurality of regulating arrangements being respectively connected in series with said LED chains such that each of said LED chains has a different one of said plurality of regulating arrangements connected in series with said each LED chain;

wherein each of said regulating arrangements includes one of a following transistor arrangement:

a) a bipolar transistor, a collector terminal of which is connected to the cathode side of the associated LED chain, and an emitter terminal of which is connected via an emitter resistor to the negative pole of the supply voltage, or b) a bipolar transistor, a collector terminal of which is connected to the anode side of the associated LED chain, and an emitter terminal of which is connected via an emitter resistor to the positive pole of the supply voltage;

a drive circuit applying a predetermined current to base terminals of the bipolar transistors; and wherein the drive circuit comprises a zener diode connected to the positive pole of the supply voltage and adapted to be operated in the reverse direction with respect to the supply voltage, and the anode of which is connected to the control inputs or to the base terminals.

10. The circuit arrangement for an LED array as claimed in claim 9, wherein a fuse is connected in series with the zener diode.

11. The circuit arrangement for an LED array as claimed in claim 10, wherein said fuse is a fusible resistor.

12. The circuit arrangement for an LED array as claimed in claim 9, wherein a resistor is connected in series with the zener diode.

13. The circuit arrangement for an LED array as claimed in claim 12, wherein the value of the resistor connected in series with the zener diode lies between 100 ohms and 1000 ohms.

14. A circuit arrangement for an LED array, comprising:

a plurality of parallel-connected LED chains, in each of which at least one LED is arranged, and when there are two or more LEDs, the latter are connected in senes, in which anode sides of the respective LED chains are coupled to a positive pole of a supply voltage and cathode sides of the respective LED chains are coupled to a negative pole of the supply voltage;

a plurality of regulating arrangements for regulating a predetermined current distribution among the LED chains, with said plurality of regulating arrangements being respectively connected in series with said LED chains such that each of said LED chains has a different one of said plurality of regulating arrangements connected in series with said each LED chain;

wherein each of said regulating arrangements includes one of a following transistor arrangement:

a) a bipolar transistor, a collector terminal of which is connected to the cathode side of the associated LED chain, and an emitter terminal of which is connected via an emitter resistor to the negative pole of the supply voltage, or b) a bipolar transistor, a collector terminal of which is connected to the anode side of the associated LED chain, and an emitter terminal of which is connected via an emitter resistor to the positive pole of the supply voltage;

a drive circuit applying a predetermined current to base terminals of the bipolar transistors; and wherein the drive circuit comprises a zener diode connected to the negative pole of the supply voltage and adapted to be operated in the reverse direction with respect to the supply voltage and the cathode of which is connected to the control inputs or to the base terminals.

15. The circuit arrangement for an LED array as claimed in claim 14, wherein a fuse is connected in series with the zener diode.

16. The circuit arrangement for an LED array as claimed in claim 15, wherein said fuse is a fusible resistor.

17. The circuit arrangement for an LED array as claimed in claim 14, wherein a resistor is connected in series with the zener diode.

18. The circuit arrangement for an LED array as claimed in claim 17, wherein the value of the resistor connected in series with the zener diode lies between 100 ohms and 1000 ohms.

19. A circuit arrangement for an LED array comprising:

a plurality of parallel-connected LED chains, in each of which at least one LED is arranged, and when there are two or more LEDs, the latter are connected in series, in which anode sides of the respective LED chains are coupled to a positive pole of a supply voltage and cathode sides of the respective LED chains are coupled to a negative pole of the supply voltage;

a plurality of regulating arrangements for regulating a predetermined current distribution among the LED chains, with said plurality of regulating arrangements being respectively connected in series with said LED chains such that each of said LED chains has a different one of said plurality of regulating arrangements connected in series with said each LED chain; and wherein each of said regulating arrangements includes a bipolar transistor, a collector terminal of which is connected to the anode side of the associated LED chain, and an emitter terminal of which is connected via an emitter resistor to the positive pole of the supply voltage, base terminals of the transistors being connected to one another, and a drive circuit applying a predetermined current to the base terminals of the transistors.

20. The circuit arrangement for an LED array as claimed in claim 19, wherein the values of the emitter resistors lie between 1 ohm and 100 ohms.

21. The circuit arrangement for an LED array as claimed in claim 19, wherein the LED array is a light signal device.

22. A circuit arrangement for an LED array comprising:

a plurality of parallel-connected LED chains, in each of which at least one LED is arranged, and when there are two or more LEDs, the latter are connected in series, in which anode sides of the respective LED chains are coupled to a positive pole of a supply voltage and cathode sides of the respective LED chains are coupled to a negative pole of the supply voltage;

a plurality of regulating arrangements for regulating a predetermined current distribution among the LED chains, with said plurality of regulating arrangements being respectively connected in series with said LED chains such that each of said LED chains has a different one of said plurality of regulating arrangements connected in series with said each LED chain; and wherein a fuse is connected in series with each of the LED chains.

* * * * *

UNITED STATES PATENT AND TRADEMARK OFFICE

CERTIFICATE OF CORRECTION

PATENT NO. : 7,317,287 B2
APPLICATION NO. : 10/496939
DATED : January 8, 2008
INVENTOR(S) : Simon Blumel It is certified that error appears in the above-identified patent and that said Letters Patent is hereby corrected as shown below:

Column 11, line 19, please correct to read as follows:

--two or more LEDs, the latter are connected in ~~senes~~ series, in--

Signed and Sealed this

Twenty-eighth Day of July, 2009

John Doll

JOHN DOLL
*Acting Director of the United States Patent and Trademark Office*